US005114345A

United States Patent [19]

Vuarnesson

[11] Patent Number: 5,114,345

[45] Date of Patent: May 19, 1992

[54] PROCESS AND APPARATUS FOR REPRESENTING TIDAL MOVEMENT

[76] Inventor: Bernard Vuarnesson, 1 Blvd. St. Michel, 75006 Paris, France

[21] Appl. No.: 517,301

[22] Filed: May 1, 1990

[30] Foreign Application Priority Data

May 5, 1989 [FR] France ..... 8905997

[51] Int. Cl.[5] ..... G04B 19/00

[52] U.S. Cl. ..... 434/130; 368/19

[58] Field of Search ..... 434/106, 131–136, 434/214–216, 284, 292, 293; 116/26; 405/76, 79, 54; 33/268; 368/15, 19

[56] References Cited

U.S. PATENT DOCUMENTS 4,849,949 7/1989 Voth ..... 368/19

4,853,908 8/1989 Bourguin et al. ..... 365/15 X

FOREIGN PATENT DOCUMENTS 3105243 2/1981 Fed. Rep. of Germany .

*Primary Examiner*—Richard J. Apley

*Assistant Examiner*—Glenn E. Richman

*Attorney, Agent, or Firm*—Alan H. Levine

[57] ABSTRACT

An ellipse is rotated in such a way that the time interval which elapses between the successive passages of the major axis of the ellipse and the minor axis of the ellipse through the same position corresponds to the time interval which elapses between a successive high tide and low tide. The ellipse is rotated substantially in phase with the lunar cycle.

10 Claims, 3 Drawing Sheets

PROCESS AND APPARATUS FOR REPRESENTING TIDAL MOVEMENT

The invention concerns a process and an apparatus for representing tidal movement.

An apparatus is known for representing the movement of the tide consisting of a needle turning at a constant rate of one turn per approximately 12 hr, 25 min in front of a circular scale graduated in tidal hours.

The object of the present invention is to provide a better representation of this movement.

According to this invention, this is basically achieved by representing the tidal movement by the rotation of an ellipse, and this rotation is accomplished in such a manner that the time interval which elapses between successive passages of the major axis of the ellipse and the minor axis of the ellipse through the same position corresponds to the time interval which elapses between a successive high tide and low tide.

According to different exemplified embodiments, the process according to the invention may feature one or several of the following additional characteristics:

(a) the contour of the ellipse is used to control the reading of a scale graduated in tidal hours;

(b) the tidal hours are represented by graduations on a fixed scale, the scale representing the mean time interval between a high tide and a succeeding low tide, the ellipse is made to turn around an axis perpendicular to the plane of the ellipse at its center, choosing the ellipse in such a way that the difference between the lengths of the major axis and the minor axis of the ellipse is equal to the deviation between the two graduations which correspond respectively to the said successive low tide and high tide, and the edge of the ellipse is used to control the reading of the graduations on the scale;

(c) the edge of the ellipse is used as a cursor on the scale;

(d) the edge of the ellipse is used as a cam to control the movement of an index on the scale;

(e) a rectilinear scale is used;

(f) the ellipse is made to turn at a variable rate along a curve related to the phase of the moon so that the rotation of the ellipse is at least approximately in phase with the lunar cycle, and the duration of a complete rotation of the ellipse varies between one turn per 24 hr, 38 min and one turn per 24 hr, 74 min, with an average of one turn per 24 hr, 52 min;

(g) the movement of the ellipse is controlled by means of a quartz crystal and a microprocessor;

(h) during the rotation of the ellipse, its center is moved by means of another ellipse, driving like a cam a circular track concentric with the first ellipse and integral with the first ellipse, imparting to the other ellipse a rotation at uniform speed of one turn per 24 hr, and the ratio of the difference between the lengths of the major axis and minor axis of the first ellipse to the difference between the lengths of the major axis and the minor axis of the other ellipse ranges between 2 and 3, is preferably between 2.3 and 2.7, and better still is equal to 2.5 or close to 2.5.

The invention also concerns an apparatus for indicating the tidal hours, characterized by the fact that it comprises an ellipse and means to make the ellipse turn around an axis perpendicular to the ellipse, and extending through its center, in such a way that the time interval which elapses between the successive passages of the major axis of the ellipse and the minor axis of the ellipse through the same position corresponds to the time interval which elapses between a successive high tide and low tide.

According to the embodiments, this apparatus may also feature one or several other characteristics listed below:

(a) it has a scale graduated in tidal hours and the ellipse is chosen in such a way that the difference between the lengths of the major axis and the minor axis of the ellipse is equal to the separation between the two graduations which correspond respectively to the stated successive low tide and high tide, and the edge of the ellipse is used to control the reading of the graduations on the scale;

(b) it comprises a scale graduated in tidal hours and the edge of the ellipse has a cam which activates the movement of a cursor on the scale;

(c) the scale is rectilinear;

(d) it comprises means for making the ellipse turn in such a way that the rotation of the ellipse is at least approximately in phase with the lunar cycle;

(e) it comprises another ellipse which drives like a cam a circular track concentric to the first ellipse and integral with the first ellipse, and the ratio of the difference between the lengths of the major axis and minor axis of the first ellipse to the difference between the lengths of the of major axis and the minor axis of the other ellipse ranges between 2 and 3, is preferably between 2.3 and 2.7, and better still is equal to 2.5 or close to 2.5, and means for making this other ellipse turn at a uniform speed of 1 turn per 24 hr.

Two embodiments of the apparatus will be described below in reference to the figures depicted in the attached drawing, in which:

FIGS. 4A–4E are diagrams of the two ellipses used in the apparatus depicted in FIG. 3;

Figure 1:
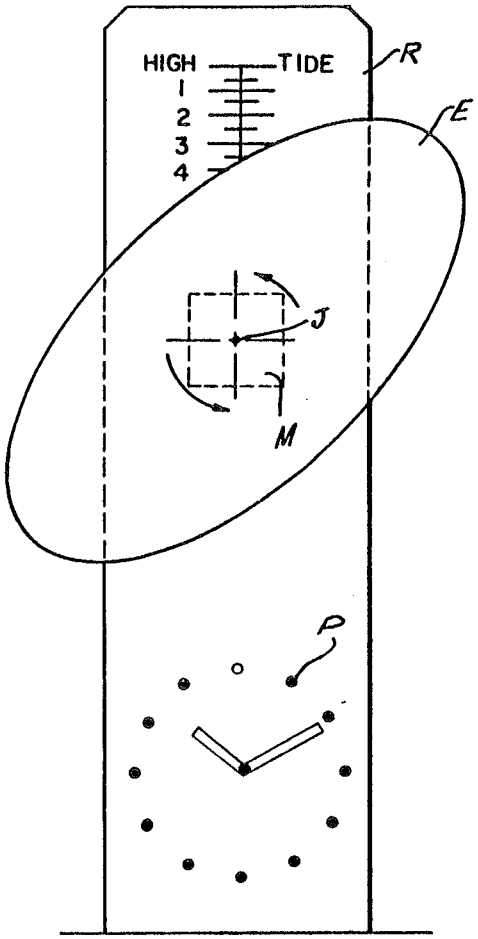
FIG. 1 is a diagram of a first illustrative embodiment of the apparatus.

The apparatus shown in FIG. 1 is a simplified version of a clock for representing the semi-diurnal tides, where the resultant of the attractions of the moon and of the sun is represented by an elliptical disc E.

The average lunar cycle is 29 days, 12 hours, 44 minutes, and 3 seconds, or 42,524 min and 3 sec. Fifty-seven high tides and 57 low tides are produced during this time. The average interval between two high (or low) tides is thus 746 min (12 hr, 26 min)+2.10 sec, or 24 hr, 52 min between four high tides.

Tidal phenomenon specialists showed some time ago that this average deviation of 52 min with respect to one solar day varies between approximately 38 and 74 min through a lunation, that the length of the tide is very close to 24 hr, 52 min during the periods of the first and last quarters of the moon (neap tide), and that it is minimal (shortest tides) at the time of the full and new moons (spring tide).

Since the variation in these deviations is very regular from one lunation to another as regards the phase of the moon (number of days elapsed since the preceding new moon) (see FIG. 2), it is thus possible to impart to the elliptic disc (FIG. 1) an irregular circular motion, but a motion which is in phase with the tide.

The figure of 42,522 min is used as the lunar revolution time (i.e., an error of 2 min and 3 sec per cycle), so that the average interval between two high tides is 746 min (57 high tides=45,522 min).

The daily variations in the speed of rotation of the elliptic disc during a lunar revolution are obtained, for example, either (1) by a chain of gears and cams driven by a clockwork movement having an axis turning at the regular speed of one turn per 746 min (or its multiples or sub-multiples), or (2) by a quartz-piloted movement, equipped with a suitable microprocessor. In FIG. 1, the mechanisms which make the ellipse turn in a counterclockwise direction around an axis perpendicular to the plane of the ellipse and located at its center (J) have been represented diagrammatically as M. It is not necessary to describe them in further detail, since their construction is within the capability of the specialist in the field considering that the functions of these mechanisms have been explained above. Also shown in FIG. 1 is the rectilinear scale R, vertical here, graduated in tidal hours, in front of which the ellipse turns in such a way that the edge of the ellipse sweeps over this scale, designating the hours in succession. The apparatus represented also includes an ordinary clock P. It is known that each point on a coastline has its own tide a certain number of minutes ahead or behind with respect to the passage of the moon through the local meridian. This figure, called establishment of the "port" or initial hour, is almost constant for each place throughout the year.

To use the tidal clock, it is thus necessary to make two preliminary adjustments:

1) adjust the infinitely variable gear transmission to the figure corresponding to the phase of the moon on the day of its activation; and
2) adjust the elliptic disc to the present state of the tide at the site under consideration.

In order to determine the state of the tide at another site, it will suffice to add or to subtract the "established" deviations between the two sites. However, it should be pointed out that since the system proposed does not take into account all the factors of variation, the time of any tide will be indicated only within one hour, while in contrast, the annual cumulative error does not exceed ½ hour.

Figure 5:
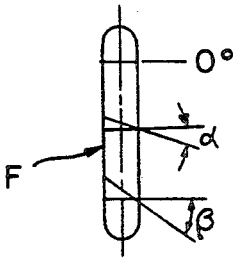
FIG. 5 is a detail view of the aperture of the apparatus depicted in FIG. 3.

This simplified apparatus has the following advantages:

(a) the representation of the movement of the tides by an ellipse reflects the mechanical reality of the phenomenon due to universal attraction;
(b) the ellipse makes it possible to represent the continuously rising and falling tidal motion as well as the two discontinuities (high tide and low tide) during the course of which the movement changes direction;
(c) if the ellipse turns in a counterclockwise direction, the slope of the tangent to the ellipse at the point of intersection of the ellipse with the vertical axis of the graduated scale, or across an aperture F (see FIG. 5), directly indicates the direction of the movement (rising tide, falling tide); and
(d) by an appropriate choice of dimension of the ellipse, it is possible to illustrate the twelfths rule (see below).

Figure 3:
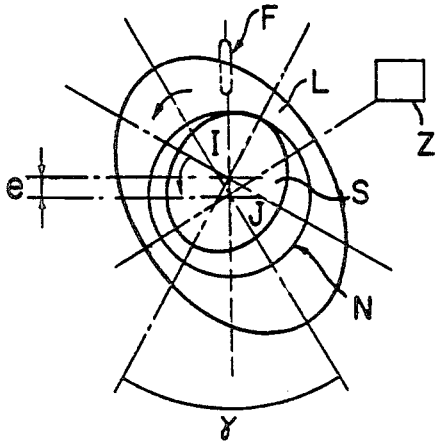
FIG. 3 is a diagram of a second illustrative embodiment of the apparatus.
Figure 4A:
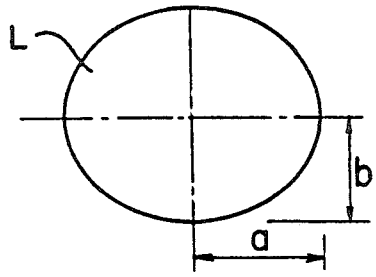
Figure 4B:
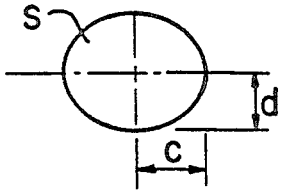

A perfected version of the apparatus is shown in FIG. 3. This apparatus comprises an ellipse L and another ellipse S representing the respective effects of the moon (ellipse L) and of the sun (ellipse S) if the ratio (b-a)/(d-c) (FIG. 4) of the difference in length between the major axis and minor axis of the large ellipse (L) to the difference in length between the major axis and minor axis of the small ellipse (S) ranges between 2 and 3, is preferably between 2.3 and 2.7, and better still, is equal to 2.5 or close to 2.5. For example, for a small tidal clock, it is possible to choose b-a=2.5 cm and d-c=1 cm. For a large wall clock, one will choose, for example, b-a=2.5 m and d-c=1 m. Of course, these examples are not limiting.

The ellipse S is placed inside the ellipse L in a central circular opening N. Appropriate means represented diagrammatically by Z impart to the ellipse S a uniform circular movement around its fixed center I of one turn per 23 hr, corresponding to the solar rhythm, and to the ellipse L a circular movement corresponding to the average rhythm of passage of the moon through the meridian, i.e., one turn in 24 hr, 52 min around its center J, which is vertically movable by the action of rotation of ellipse S, which acts like a cam within the circular opening N in ellipse L.

The apparatus contains a vertical scale (represented diagrammatically by the aperture F, see also FIG. 5) graduated in tidal hours. If the above examples are used, the graduations cover 2.5 cm (small clock) or 2.5 m (wall clock).

Figure 6A:
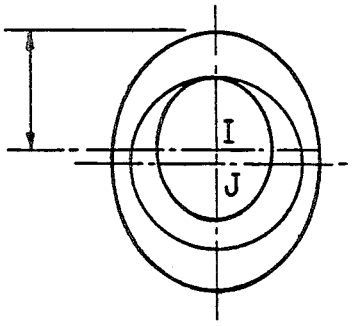
FIGS. 6A–6D are diagrams of certain of the positions of the ellipses of the apparatus depicted in FIG. 3 during a rotation.
Figure 6B:
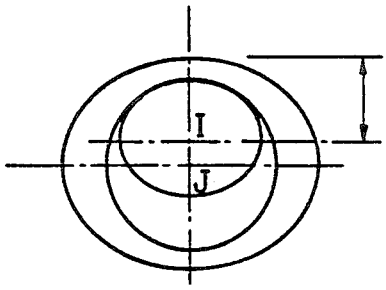
Figure 6C:
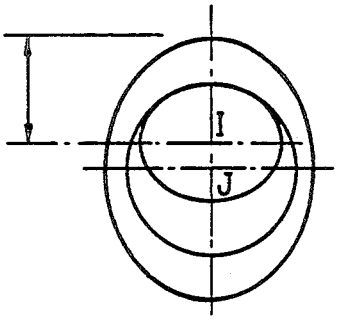
Figure 6D:
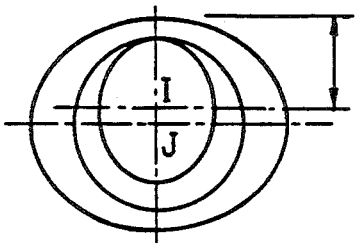

When the two major axes of the ellipse are parallel, the two actions of the sun and the moon are combined; these are the high (FIG. 6A) and low (FIG. 6B) tides of spring tide (during the syzygial periods, i.e., full moon and new moon). When the two major axes of the ellipses form an angle of 90°, the actions of L and S run counter to one another; these are the high (FIG. 6C) and low (FIG. 6D) tides of neap tide (in the quadrature periods, i.e., first quarter and last quarter).

Figure 2:
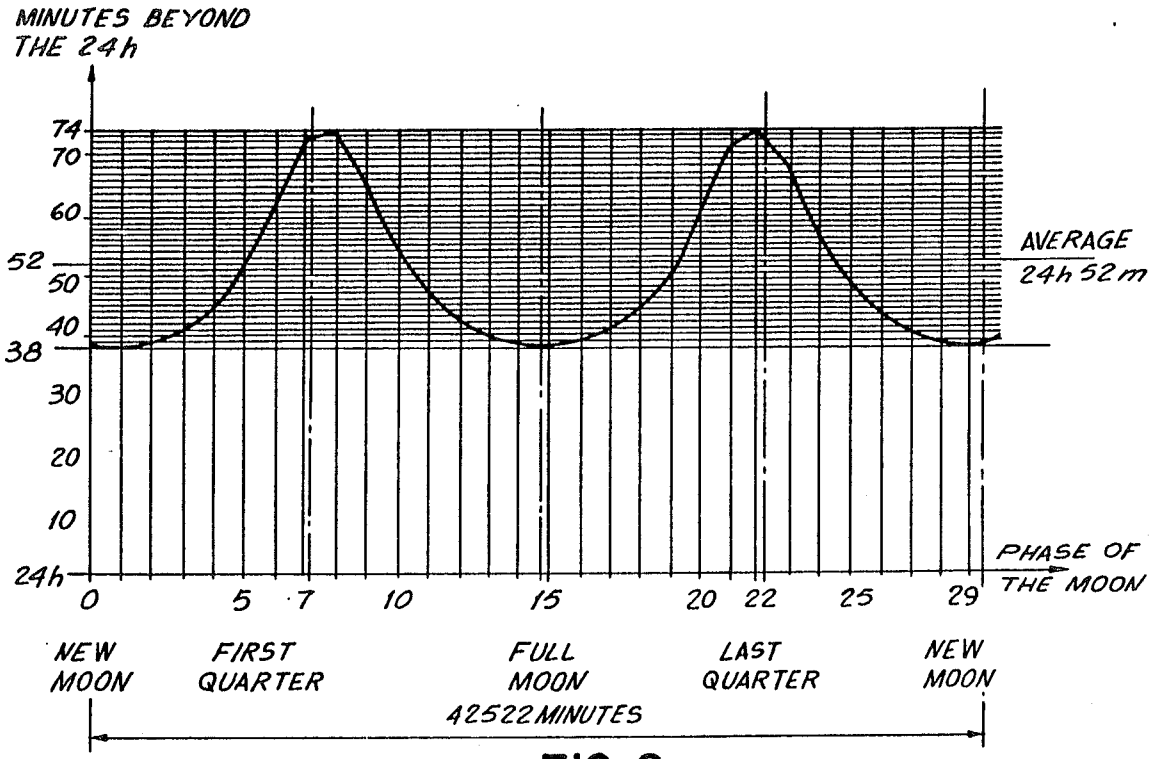
FIG. 2 is a graph representing the deviations between four high (or low) tides according to the phase of the moon.

This apparatus furnishes several categories of indications for coasts subject to the semi-diurnal tideal system. If the ellipse L is rotated in a counterclockwise direction and the ellipse S in a clockwise direction:

(a) when the ellipse L has its major axis vertical, it is the high tide period;
(b) the direction of the rising or falling phenomenon is seen constantly in an appropriate aperture (detail FIG. 5) according to the general convention of the signs
/=rising; \=falling;
(c) by means of an appropriate ellipse plot it is possible to judge the speed of rise or fall of the tide proportionately to the angle $\alpha$ or $\beta$ seen in the aperture (FIG. 5), and to thereby visually plot the twelfths rule (the level rises or falls by 1/12 the first hour, 2/12 the second hour, 3/12 the third hour and fourth hour, 2/12 the fifth hour, and 1/12 the sixth hour);

(d) the height of the apex of the ellipse L, seen in the aperture, gives an indication as to the amplitude of the tide (neap and spring tides); it is possible to produce a double-graduated scale, since the height of the tides is linked to the phase of the moon according to a curve of the same nature as that shown in FIG. 2 (the tidal coefficients are maximal at the syzygies and minimal at the quadratures). In practice, to separate these two reading scales, it is possible to link the tidal time scale to the axis J in such a way that it rises and falls vertically at the same time as the ellipse L, and thus the same reading is obtained as on the simplified instrument depicted in FIG. 1.

It is also possible to provide (FIG. 8) an index linked to the vertical movement of the axis 3 in front of a second fixed graduation F' integral with the apparatus stand. The height of the tides (or coefficient) varies in the same direction as the distance of the axes I and J (FIG. 6) measured at high tide. A mask may be desirable so that F' is legible only when the major axis of ellipse L is vertical.

Figures 7A, 7B, 7C, 7D:
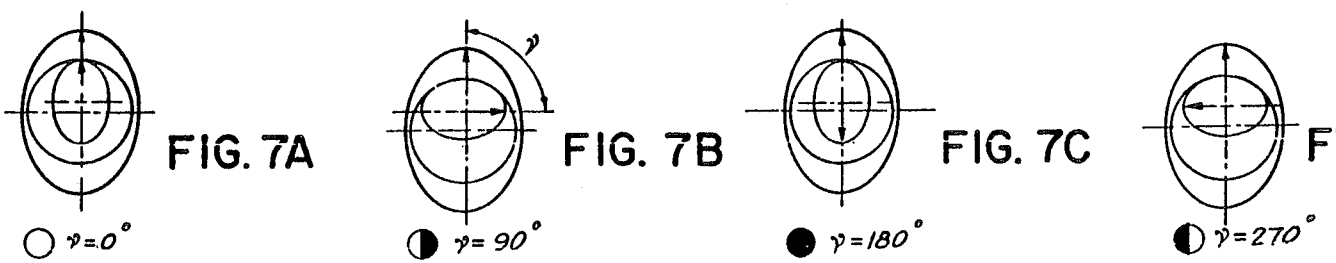
FIGS. 7A–7D are diagrams of certain of the positions of the ellipses in relation to the phase of the moon.

If the two ellipses S and L turn in the same direction, and the angle $\gamma$ formed by their two large axes varying from 0° to 360° during the course of a lunar cycle (FIG. 7), the phase of the moon can be read directly on a circular disc D integral with S and with the same center I (FIG. 8), graduated into 29.5 lunar days. The lunar days on the disc D will be read in reference to a point F plotted on a semi-large axis of the ellipse L.

Figure 9:
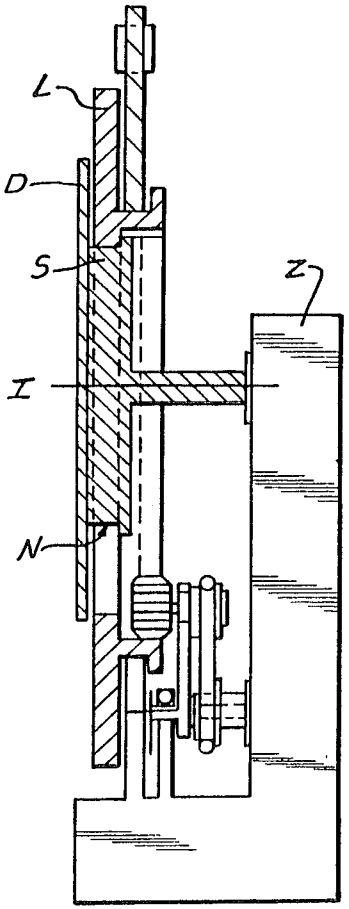
FIG. 9 is a cross-section of the apparatus depicted in FIG. 8 taken along line 9—9 of FIG. 8.
Figure 8:
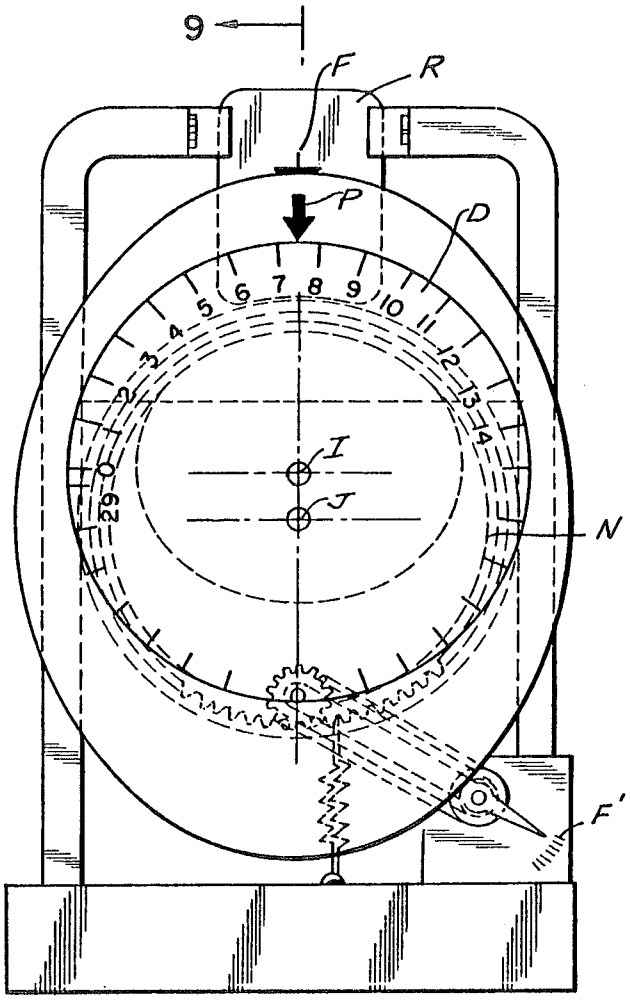
FIG. 8 is a diagram of a front view of an embodiment according to FIG. 3, comprising an additional scale for indicating the tidal coefficients.

This disc D can be situated in front of ellipse L, as in the case of FIG. 8, or behind ellipse L, and in this case, the reading will be done through an aperture provided in L. Disc D can be adjusted in rotation around the center I with respect to the ellipse S in such a way as to regulate the lunar calendar independently of the local tidal times.

It is known that the speed of rotation of the ellipse L is not constant; there will thus be deviations in reading the phase of the moon due to the variation from 24 hr, 38 min to 24 hr, 74 min, mentioned previously. Nevertheless, since the average is exactly 24 hr, 52 min, the accuracy of this lunar calendar will be sufficient.

To plot the tidal phenomenon more completely, it is possible to link the speed of rotation of the ellipse L to longer-period phenomena, e.g., the saros cycle of approximately 18 years.

The direction of rotation of the two ellipses has no influence on the outcome of the tidal times and heights. However:

1) to read the phase of the moon (variations in $\gamma$), the two ellipses must turn in the same direction;
2) to perceive, at first glance, the direction of the tide (rising or falling) according to the usual convention or signs (rising /, falling ) the ellipse L must turn in a counterclockwise direction;
3) if it is desired to read the time directly, with 24 graduations per turn instead of 12 as on a classical clock dial, the ellipse S must turn in a clockwise direction.

I claim:

1. Apparatus for representing tidal movement, comprising:

an elliptical element rotatable about an axis perpendicular to the plane of the ellipse and passing through the center of the ellipse, means for rotating the elliptical element at a variable speed between one revolution per 24 hours, 38 minutes and one revolution per 24 hours, 74 minutes, the average speed of rotation being one revolution per 24 hours, 52 minutes during any single lunar cycle, and a scale graduated in hours between high and low tides, the elliptical element and scale being so relatively positioned that at any given time the position of the edge of the ellipse with respect to the scale graduations indicates the amount of time which must elapse until the next high or low tide.

2. An apparatus as defined in claim 1 wherein the difference between the lengths of the major and minor axes of the ellipse is equal to the distance on the scale between the high tide and low tide graduations.

3. An apparatus as defined in claim 2 wherein the scale is linear.

4. An apparatus as defined in claim 1 wherein the means for rotating the elliptical element includes a quartz crystal and a microprocessor.

5. An apparatus as defined in claim 1 including a circular track fixed to, and concentric with, the ellipse, a second elliptical element arranged with its edge in driving relationship with the track, and means for rotating the second elliptical element at a uniform speed of one revolution per 24 hours.

6. An apparatus as defined in claim 5 wherein the ratio between (a) the difference between the lengths of the major and minor axes of the first-mentioned ellipse and (b) the difference between the lengths of the major and minor axes of the second ellipse, is between 2.3 and 2.7.

7. An apparatus as defined in claim 6 wherein said ratio is about 2.5.

8. An apparatus as defined in claim 5 wherein the rotational axis of the first-mentioned elliptical element moves rectilinearly in response to rotation of the second elliptical element, and including a fixed scale graduated in tidal coefficients, and an indicator movable over the scale in response to rectilinear movement of the first-mentioned ellipse.

9. An apparatus as defined in claim 5 including a circular disk fixed to, and concentric with, the second elliptical element, the circular disk carrying graduations in lunar days, and a reference point movable with the first-mentioned elliptical element for cooperating with the graduations to provide reading of the lunar days.

10. A method for representing tidal movement comprising the steps of:

providing an ellipse rotatable about an axis perpendicular to the plane of the ellipse and passing through the center of the ellipse, rotating the ellipse at a variable speed between one revolution per 24 hours, 38 minutes and one revolution per 24 hours, 74 minutes, the average speed being one revolution per 24 hours, 52 minutes during any single lunar cycle, providing a scale graduated in hours between high and low tides, and relatively positioning the ellipse and scale so that the edge of the ellipse with respect to the scale indicates the amount of time which must elapse until the next high or low tide.

* * * * *